United States Patent [19]

Deutsch

[11] Patent Number: 4,601,229

[45] Date of Patent: Jul. 22, 1986

[54] POLYPHONIC TONE SYNTHESIZER WITH HARMONIC RANGE SELECTION

[75] Inventor: Ralph Deutsch, Sherman Oaks, Calif.

[73] Assignee: Kawai Musical Instrument Mfg. Co., Ltd., Hamamatsu, Japan

[21] Appl. No.: 720,471

[22] Filed: Apr. 5, 1985

[51] Int. Cl.[4] ..... G10H 1/02

[52] U.S. Cl. ..... 84/1.01; 84/1.22

[58] Field of Search ..... 84/1.01, 1.22, 1.24, 84/1.25

[56] References Cited

U.S. PATENT DOCUMENTS

| | | | |
|---|---|---|---|
| 4,022,098 | 5/1977 | Deutsch et al. | 84/1.01 |
| 4,085,644 | 4/1978 | Deutsch et al. | 84/1.01 |
| 4,357,851 | 11/1982 | Markowitz et al. | 84/1.01 |
| 4,375,178 | 3/1983 | Whitefield | 84/1.25 |
| 4,468,996 | 9/1984 | Deutsch | 84/1.01 |

*Primary Examiner*—Russell E. Adams

*Attorney, Agent, or Firm*—Ralph Deutsch

[57] ABSTRACT

In a keyboard operated electronic musical instrument in which a plurality of data words corresponding to the amplitudes of a corresponding number of evenly spaced points defining a cycle of an audible musical waveform are transformed at an average rate corresponding to the fundamental frequency of the tone being generated, a computation means is provided whereby the number of data words is varied adaptively with the fundamental frequency. The adaptive variation in the number of data points per waveshape cycle is accompanied by an associated adaptive variation in the maximum number of harmonics for the generated musical tone.

9 Claims, 3 Drawing Figures

POLYPHONIC TONE SYNTHESIZER WITH HARMONIC RANGE SELECTION

BACKGROUND OF THE INVENTION

1. Field of the Invention

This invention relates to musical tone synthesis and in particular is concerned with an improvement for systems producing an extended range of harmonics.

2. Description of the Prior Art

Digital musical tone generators are being designed with an ever increasing extension in the maximum number of harmonics. Large numbers of harmonics can present some system logic speed problems. It is apparent that it is not economical to generate tones with large number of harmonics for the entire range of keyboard frequencies. If the number of harmonics is kept at a constant number then the overtone frequencies for the higher octaves fall far above the upper frequency threshold of the listeners.

In U.S. Pat. No. 4,085,644 there is described a polyphonic tone synthesizer in which a master data set of numerical values is computed and stored in a main register from which it is transferred to note registers of a plurality of tone generators. The master data set defines the amplitudes of equally spaced points for a period of the audio waveform of the musical tones being generated. Each tone generator receives the data words in the master data set and transfers them to a digital-to-analog converter at a rate corresponding to an actuated keyboard switch which is assigned to a tone generator.

One of the features of the polyphonic tone synthesizer, as described in the above-identified patent, is that the transfer of successive words from the master data set in the main register to an individual note register in the respective tone generators is synchronized with the transfer of data words from the note register to the digital-to-analog converter. This feature permits the master data set defining the waveform to be recomputed and loaded in the respective tone generators without interrupting the generation of musical tones. The rate at which the waveform can be varied as a function of time is limited by the length of time required for a computation cycle during which the master data set is generated and by the length of time required to transfer the data from the main register to the note registers in each of the tone generators which have been assigned to actuated keyswitches.

In U.S. Pat. No. 4,231,278 a master data set computing subsystem for the tone generator described in U.S. Pat. No. 4,085,644 is described which adaptively computes the set of master data set points in response to values of preselected harmonic coefficients. The computation subsystem advances past all harmonic coefficients of smaller value than a selected threshold value thereby reducing the required computation time and making the musical instrument improve its capability of generating time variant tonal changes.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted into musical waveshapes. A sequence of a computation cycles is implemented during each of which a master data is generated corresponding to one actuated keyswitch. A master switch set comprises a set of data points which defines a period of a musical waveshape that will be produced by a tone generator assigned to the actuated keyswitch.

A frequency assignor assigns a frequency number to each actuated keyboard switch. A select signal is encoded to denote one of a number of preselected non-overlapping frequency ranges in which the assigned frequency number falls. The master data set is computed by implementing a discrete Fourier transform algorithm using a subset of a preselected set of harmonic coefficients. The harmonic coefficient subset is chosen in response to the encoded select signal. The number of data points compute to define the period of the musical waveshape is adaptively varied in response to the frequency range assigned to an actuated keyswitch. The master data is stored in a waveshape memory. The musical tone is obtained by sequentially and repetitively reading out the master data set points from the waveshape at a rate corresponding to the fundamental musical frequency associated with the actuated keyswitch. These read out points are converted into an analog signal by means of digital-to-analog converter.

The computational system adaptively varies the computation time to correspond to the frequency range in which an actuated keyboard is associated. The adaptive computation provides a reduction in the computation time for higher frequency notes as well as a method of reducing the maximum number of generated harmonics so that excessively high overtone frequencies are not generated.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward an improvement of a waveshape computation system of the type described in detail in U.S. Pat. No. 4,085,644 entitled Polyphonic Tone Synsthesizer. The patent is hereby incorporated by reference. In the following description all elements of the system which are described in the referenced patent are identified by two digit numbers which correspond to the same numbered elements appearing in the referenced patent U.S. Pat. No 4,085,644.

Figure 1:
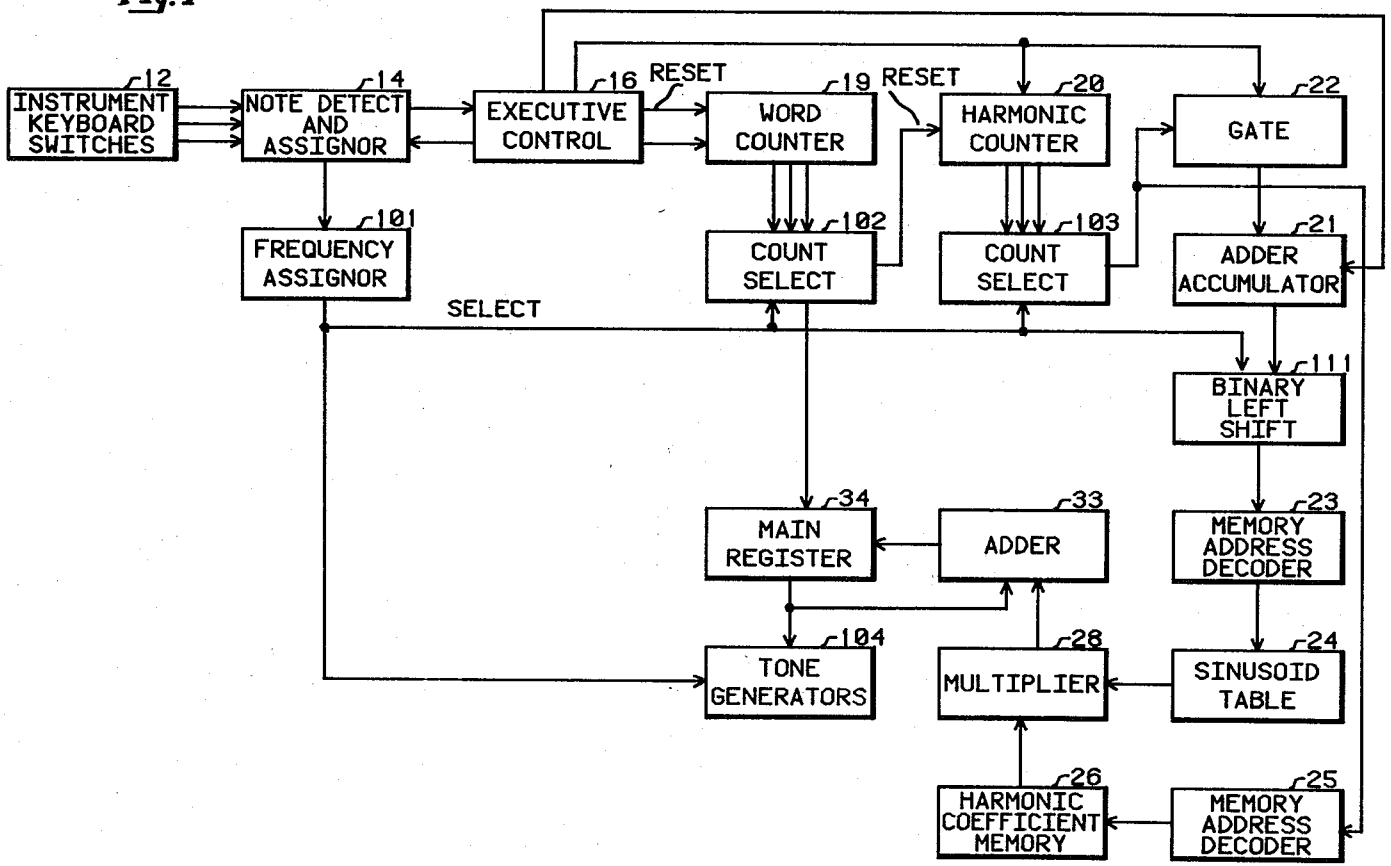
FIG. 1 is a system block diagram of the musical waveform generator.

FIG. 1 shows an embodiment of the present invention which is described as a modification and adjunct to the system described in the referenced patent U.S. Pat. No. 4,085,644. The preferred embodiment is one in which a computation cycle is initiated to compute a master data set which is then transferred to a note register associated with a single assigned tone generator. As soon as the transfer of the master data set is completed, a second computation cycle is immediately started to compute an independent master data set for a second assigned tone generator. This sequence of a computation cycle followed by a transfer cycle is continued until a new master data set has been computed and transferred to each of the assigned tone generators. At this time the complete computation and transfer process is repeated so that the tone generators are individually continuously supplied with constantly updated independent master data sets. This operation sequence permits an independent sliding formant to be implemented for the subset of assigned tone generators. Moreover the implementation of the sequence of independent computation cycles and transfer cycles enables the present invention to supply each assigned tone generator with a master data set having a number of data points and a maximum number of harmonics which is adaptively determined by the instrument keyboard switch to which a tone generator is assigned.

As described in the above referenced patent, the Polyphonic Tone Synthesizer includes an array of instrument keyboard switches 12. If one or more of the keyboard switches has a switch status change and is actuated ("on" switch position), the note detect and assignor 14 encodes the detected keyboard switch having the status change to an actuated state and stores the corresponding note information for the actuated keyswitches. A tone generator, contained in the system block labeled tone generators 104, is assigned to each actuated keyswitch using information generated by the note detect and assignor 14.

A suitable configuration for a note detect and assignor subsystem is described in U.S. Pat. No. 4,022,098. This patent is hereby incorporated by reference.

When one or more keyswitches have been actuated, the executive control 16 initiates a repetitive sequence of individual computation cycles follow by associated transfer cycles. To illustrate the inventive system the system operation will be described for the case in which the frequency range is divided into four non-overlapping ranges. Range 1 is selected so that none of the harmonics for a waveshape having 128 harmonics will exceed a maximum frequency of 30 Khz. Range 2 is selected from range 1 to a waveshape having 64 harmonics such that no harmonic frequency exceeds a maximum frequency of 30 Khz. Range 3 is selected from range 2 to a waveshape having 32 harmonics such that no harmonic frequency exceeds a maximum of 30 Khz. Range 3 is selected from range 2 to the highest keyboard note. For a typical electronic organ keyboard range 1 will extend from $C_2$ to $A\#_3$; range 2 will extend from $B_3$ to $A\#_4$; range 3 will extend from $B_4$ to $A\#_5$ and range 4 will extend from $B_5$ to $C_7$. The division of the notes into these ranges is arbitrary and other ranges can be chosen as these ranges do not present any limitation to the present invention.

The word counter is implemented as a binary counter having a maximum word length of 8 bits. At the start of a computation cycle the word counter 19 is initialized to its minimal count state (zero binary value) by a RESET signal provided by the executive control 16. Clock signals, transferred by the executive control, are used to increment the count states of the word counter 19.

In a manner described below, the frequency assignor 101 generates a SELECT signal which is encoded to indicate the frequency range number for the current computation cycle corresponding to an assigned tone generator. If the SELECT signal is encoded for an actuated keyboard switch in range 1, the count select 102 will select the full 8 bit count content of the word counter 19 to be used as a data address for reading and writing computed master data set words from and to the main register 34. If the SELECT signal is encoded for range 2, the count select 102 will select the 7 least significant bits of the count content of the word counter 19. If the SELECT signal is encoded for range 3, the count select 102 will select the 6 least significant bits of the count content of the word 19. If the SELECT signal is encoded for range 4, the count select 102 will select the 5 least significant bits of the count content of the word counter 19. In this fashion a fraction of the count state of the word 19 is selected.

The harmonic counter 20 is implemented as a binary counter having a maximum word length of 7 binary bits. At the start of a computation cycle, the harmonic counter 20 is initialized to its minimal count state (zero binary value) by a signal furnished by the executive control 16. Each time that the data word selected by the count select 102 has a zero binary value, a RESET signal is generated by the count select 102. This RESET signal is used to increment the count state of the harmonic counter 20.

If the SELECT signal furnished by the frequency assignor 101 is encoded for range 1, the count select 103 will select the full 7bit count content of the harmonic counter 20. If the SELECT signal is encoded for range 3, the count select 103 will select the 5 least significant bits of the count content of the harmonic counter 20. If the SELECT signal is encoded for range 4, the count select 103 will select the 4 significant bits of the count content of the harmonic counter 20. In this fashion a fraction of the count state of the harmonic counter 20 is selected.

At the start of each computation cycle, the accumulator in the adder-accumulator 21 is initialized to a zero value in response to a signal provided by the executive control 16. Each time the word counter 19 is incremented, the executive control 16 provides a signal to the gate 22 so that the current portion of the count state of the harmonic counter 20 selected by the count select 103 is transferred to the add-accumulator 21. The adder-accumulator 21 adds the transferred portion of the current count state of the harmonic counter 20 to the sum contained in the accumulator.

The content of the accumulator in the adder-accumulator after being scaled by the binary left shift 111 is used by the memory address decoder 23 to access trigonometric function values from the sinusoid table 24.

If the SELECT signal furnished by the frequency assignor 111 is encoded for range 1, then the binary left shift 111 transfers the content of the accumulator in the adder-accumulator 21 unaltered to the memory address decoder 23. If the SELECT signal is encoded for an actuated keyswitch in range $k(k=1,2,3,4)$, then the input data word to the binary left shift is shifted to the left by $k-1$ bit positions and the modified data word value is furnished to the memory address decoder 23. The left binary shift 111 operation has the effect of multiplying the input data value by a scale factor of $2^{(k-1)}$ to select a fraction of the input data value.

The sinusoid table 24 may be implemented as an addressable memory which stores values of the trigonometric function $\sin(2\ m\pi/\ 256)$ for values of m in the range of $0 \leqq m \leqq 256$.

The memory address decoder 25 reads out harmonic coefficients stored in the harmonic coefficient memory 26 in response to the portion of the count state of the harmonic counter 20 selected by the count select 103.

The harmonic coefficient memory 26 is an addressable memory which stores 128 harmonic coefficients in memory addresses corresponding to the associated harmonic numbers. The harmonic coefficients are preselected to conform to a predetermined musical tone.

The multiplier 28 multiplies the trigonometric function value read out from the sinusoid table 24 by the harmonic coefficient value read out from the harmonic coefficent memory 26.

Master data set data words are read out from the main register 34 in response to the portion of the content of the word counter 19 selected by the count select 102. The read out data word values are added to the product value produced by the multiplier 28 by means of the adder 33. The summed values are then stored in the main register 34 at the same address from which a data value had been accessed.

After a completion of computation cycle, the master data set residing in the main register 34 is transferred to a note register in one of the tone generators which is contained in the system block labeled tone generators 104.

A computation cycle comprises WH logic clock times to complete. W is the decimal equivalent of the maximum value of the binary word selected by the count select 102 and H is the decimal equivalent of the maximum value of the binary word selected by the count select 103. For range k,(k=1,2,3,4), W is equal to $2^{9-k}$, and H is equal to $2^{8-k}$. For example, for a note in range 4 (k=4) the computation cycle interval requires $2^5 \times 2^4 32\ 512$ logic clock periods.

Figure 2:
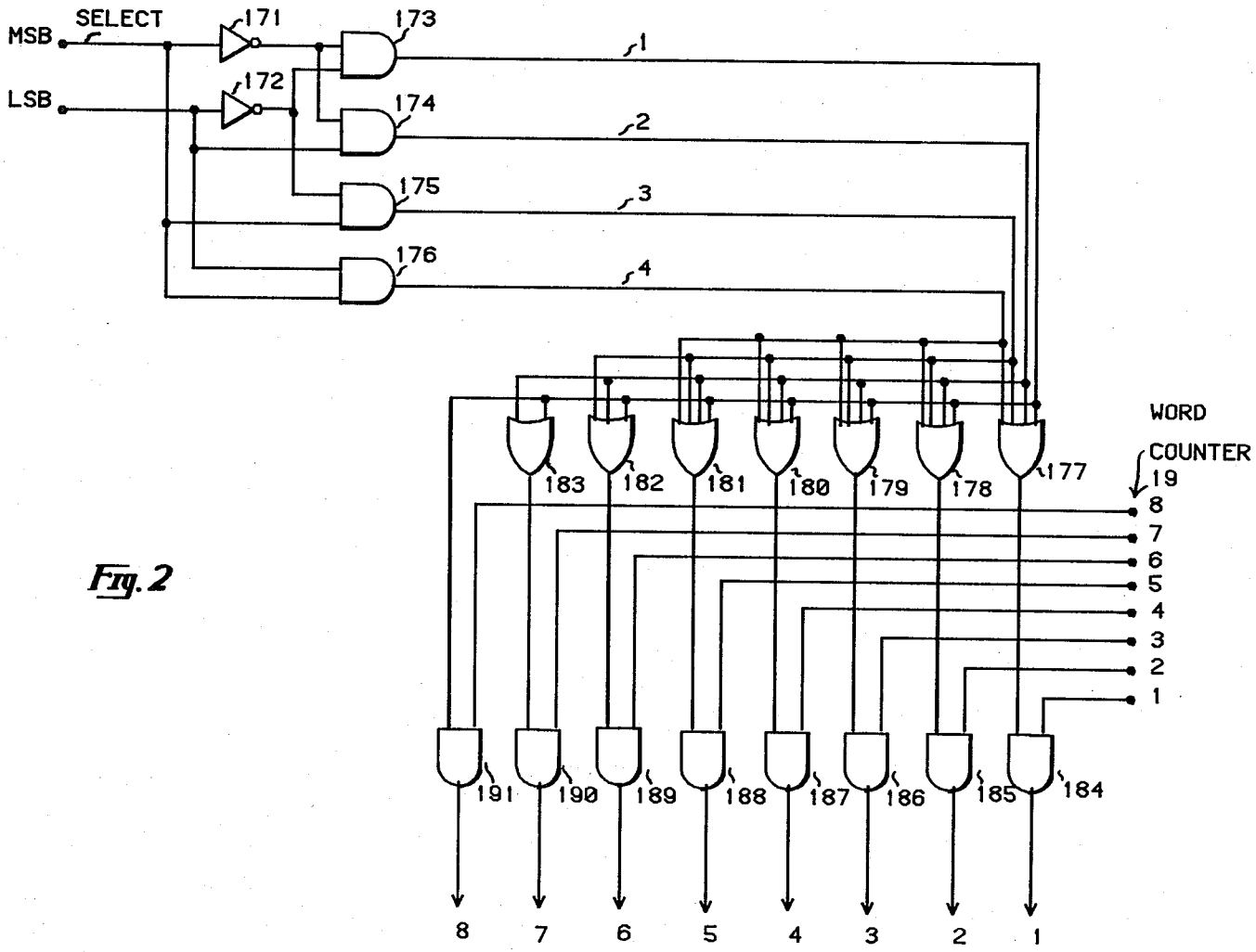
FIG. 2 is a system block diagram of the count select 102.

FIG. 2 is a logic diagram of the count selct 102. The eight lines from the word counter 19 carry the logic state signals of the content of the complete 8 bit binary count state of the word counter. These logic state signals are indiviually connected to the set of AND-gates 184–191. The SELECT signal from the frequency assignor 101 is encoded on two signal lines. The individual ranges are decoded from the SELECT signal by means of the combinatin of the inverters 171, 172 and the AND-gates 173–176. The decoded range signals are labeled in FIG. 2. The set of AND-gates 177–183 are used to combine the decoded range signals and to supply the combine signals to the AND-gates 184–191.

The count select 103 is implemented in an analogous fashion to the logic for the count select 102 shown in FIG. 2.

The system action of the count select 102; count select 103, and the binary left shift 111 can be illustrated by an examination of the generating equation for a master data set. For range 1, the master data set is computing according to the relation for a discrete Fourier transform $$z_n = \sum_{q=1}^{128} c_q \sin(2\pi nq/256) \quad n = 1,2,\ldots,256 \qquad \text{Eq. 1}$$

In this case the word counter 19 counts the states of n=1 to 256 or is an 8 bit binary counter. The harmonic counter 20 counts the sequence of harmonic numbers q=1,2 . . . , 128 or is a 7 bit binary counter. $c_q$ represents the harmonic coefficient for the harmonic number q.

For range 2, the master data set is computed according to the relation $$z_n = \sum_{q=1}^{64} c_q \sin(2\pi nq/128) \quad n = 1,2,\ldots,128 \qquad \text{Eq. 2}$$

For range 2, the count select 102 selects the 7 least significant bits of the content of the word counter 19. This is equivalent to having a 7 bit binary counter. The count select 103 selects the 6 least significant bits of the content of the harmonic counter 20. This is equivalent to having a 6 bit binary counter. The only remaining problem to resolve in evaluating Eq. 2 is in the reading out the proper stored trigonometric function values from the sinusoid table 24 which stores the value of sin(2 πm/256). In order to use the same sinusoid table which is used to evaluate Eq. 1, it is necessary for computing range 2 master data set values to double the argument value nq which is used by the memory address decoder 23 to read the trigonometric function values from the sinusoid table 24. This required doubling of the addressing argument value is accomplished by the left binary shift of one bit introduced by the binary left shift 111. The memory address decoder addressees out the proper sequence of harmonic coefficients $c_q$ from the harmonic coefficient memory in response to the partial content of the count state of the harmonic counter 20 selected by the count select 103. It is noted that for the case of a range 2 value of the SELECT signal, oly the first 128 address locations in the main register 34 contain the master data set. The second half of the main register 34 locations contain zero data values which are not used in the computation cycle.

In general for a SELECT signal for range k, the master data set is computed according to the relation $$z_n = \sum_{q=1}^{H} c_q \sin(2\pi nq/W) \quad n = 1,2,\ldots,W \qquad \text{Eq. 3}$$

Since the sinusoid table 24 stores the values of sin(2 πm/256) the binary left shift must multiply the addressing argument by $2^{(k-1)}$ to obtain the correct trigonometric function values. In general only the first $2^{9-k}$ addresses of the main register 34 are used to store the master data set for a SELECT signal for range k.

Figure 3:
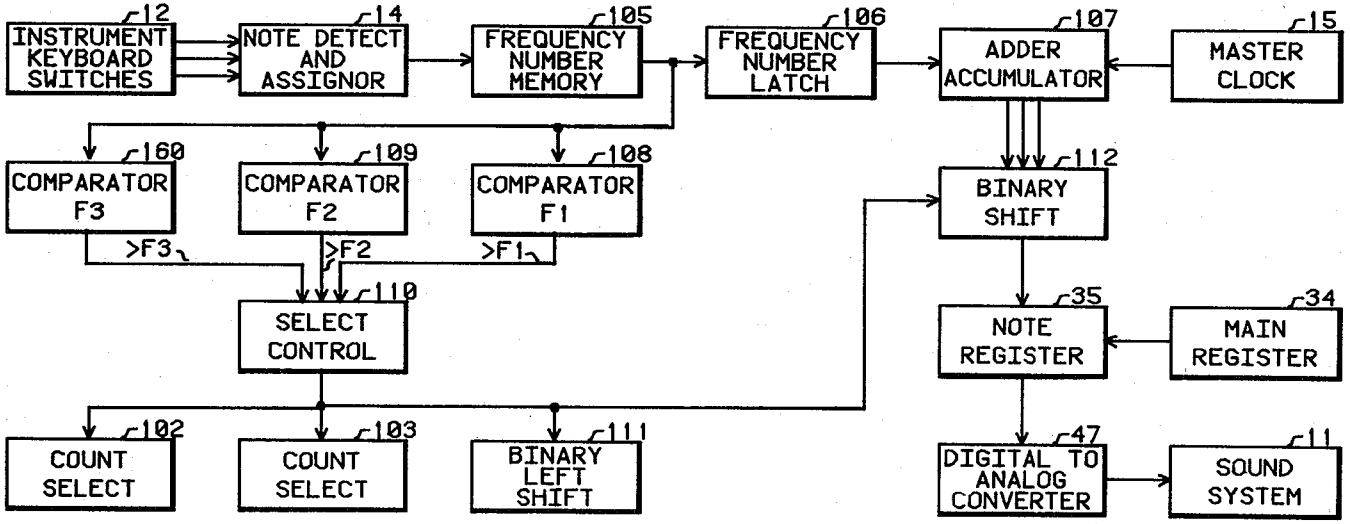
FIG. 3 is a system block of the frequency assignor and tone generator.

FIG. 3 illustrates the details of the frequency assignor 101 and the method for converting the master set data to an audible musical tone. While only a single tone generator is shown explicitly in FIG. 3, the extension to a plurality of tone generators which share common main system elements is evident from the following description of the subsystem operation. The frequency assignor 101 comprises the system blocks labeled frequency number memory, comparator 108, comparator 109, comparator 160, and the select control 110.

When the note detect and assignor 14 detects that a keyboard switch has been actuated, a corresponding frequency number is read out from the frequency number memory 105. The frequency number memory 105 can be implemented as a read-only addressable memory (ROM) containing data words stored in binary numeric format having values 2−(M−N)/12 where N has the range of values N=1,2, . . . , M and M is equal to the number of keyswitches on the musical instrument's keyboard. The frequency numbers represent the ratios of the frequencies of generated musical tones with respect to the frequency of the system's logic clock. A detailed description of the frequency numbers is contained in U.S. Pat. No. 4,114,496 entitled "Note Frequency Generator For A Polyphonic Tone Synthesizer." This patent is hereby incorporated by reference.

The frequency number read out from the frequency number memory 105 is stored in the frequency number latch 106. The frequency number stoned in the frequency number latch 106 is added successivey to the content of the accumulator in the adder-accumulator 107 in response to timing signals provided by the master clock 15.

The frequency number read out from the frequency number memory 105 is provided to the set of comparators 108, 109 and 160. The comparator 108 will generate a logic state output of "1" if the input frequency number is greater than the frequency number for $A\#_3$ which is stored in the comparator. This output is the >F1 (greater than F1) line shown in FIG. 3. The comparator 109 will generate a logic "1" signal state on the line labeled >F2 if the input frequency number is greater than the stored value of the frequency number corresponding to $A\#_4$. The comparator 160 will generate a logic "1" signal state on the line labeled >F3 if the input frequency number is greater than the stored value of the frequency number correspoding to $A\#_5$.

The select control 110 uses the signals on the three input lines from the comparators to encode the SELECT signal. Table 1 lists the signal line states and the associated encoding for the SELECT signal.

TABLE 1

| COMPARATOR SIGNALS | | | SELECT SIGNAL | |
|---|---|---|---|---|
| >F1 | >F2 | >F3 | MSB | LSB |
| 0 | 0 | 0 | 0 | 0 |
| 1 | 0 | 0 | 0 | 1 |
| 1 | 1 | 0 | 1 | 0 |
| 1 | 1 | 1 | 1 | 1 |

The select control can encode the SELECT signal by means of a ROM which stores the four SELECT signal data words and is addressed by the three signal lines from the output of the three comparators.

If the SELECT signal is encoded for range 1, then the binary shift 112 transfers the eight most significant bits contained in the accumulator in the adder-accumulator 107 to be used to address out master data set values stored in the note register 35. If the SELECT signal is encoded for range 2, then the binary shift 112 selects the 7 most significant bits from the accumulator in the adder-accumulator 107.

In general for range k the binary shift 112 selects the (9−k) most significant bits from the accumulator.

The data words selected by the binary shift 112 are used to access master data point words stored in the note register 35. The accessed data words are converted into an analog signal by means of the digital-to-analog converter 47. The sound system 11 converts the analog signal into an audible musical tone.

While the invention has been illustrated for master data sets which differ in size by powers of 2, this is not a restrictive limitation and is selected as the preferred embodiment because of the ease in which factors of 2 can be implemented in digital circuitry operating on binary numeric data values. Other numbers can also be used by replacing the count select 102 and count select 103 with digital logic to implement a division of the numeric value of the content of their respective associated counters. The binary left shift 111 would both have to be implemented with the more general division logic circuitry.

I claim:

1. In combination with a keyboard operated musical instrument having a plurality of keyswitches in which a plurality of data words corresponding to the amplitudes of evenly spaced points defining the waveform of a musical tone are computed during each one of a sequence of computation cycles from a preselected set of harmonic coefficients and are transferred sequentially and converted into musical waveshapes at a rate proportional to the fundamental frequency of the musical tone being generated, apparatus for adaptively varying the number of said plurality of data words to the fundamental frequency of said generated musical tone comprising;

a detection means responsive to the closure of a keyswitch in said plurality of keyswitches whereby a select signal is encoded to denote one of a plurality of non-overlapping fundamental frequency ranges associated with said plurality of keyswitches, a harmonic coefficient memory means for storing a preselected set of harmonic coefficients, a waveshape memory means, a harmonic addressing means responsive to said select signal for reading out a subset of said preselected set of harmonic coefficients from said harmonic coefficient memory means, a computing means responsive to said select signal and responsive to said subset of said preselected set of harmonic coefficients whereby said number of said plurality of data words are computed and stored in said waveshape memory means and whereby said number is adaptively varied to correspond to the fundamental frequency of said generated musical tone, and a means for producing musical tones responsive to the number of said plurality of data words in said waveshape memory means.

2. Apparatus according to claim 1 wherein said detection means comprises;

a keyswitch state detect means wherein a detect signal is generated in response to each actuated keyboard switch in said plurality of keyswitches, a frequency number means for generating a frequency number in response to each said detect signal, and an encoding means whereby said select signal is encoded to denote one of a plurality of non-overlapping fundamental frequency ranges associated with said plurality of keyswitches.

3. Apparatus according to claim 2 wherein said frequency number means comprises;

a frequency number memory for storing a set of frequency numbers, and a frequency number addressing means responsive to each said detection whereby a corresponding frequency number is read out from said frequency number memory.

4. Apparatus according to claim 2 wherein said encoding means comprises;

a plurality of comparator means wherein each comparator generates a comparison signal having a binary logic state selected in response to said generated frequency number, and encoding circuitry responsive to the comparison signals generated by said plurality of comparator of means whereby said select signal is encoded to denote on of a plurality of non-overlapping fundamental frequency ranges associated with said plurality of keyswitches.

5. Apparatus according to claim 1 wherein said computing means comprises;

a logic clock means for providing logic timing signals, a word counter incremented by said logic timing signals whereby said logic timing signals are counted modulo the number of said plurality of data words corresponding to the amplitudes of evenly spaced points defining the waveform of a musical tone corresponding to the lowest of said non-overlapping frequency ranges, a word counter select means responsive to said encoded select signal whereby a fraction of the count state of said word counter is selected to form a selected word count number, a harmonic counter incremented each time said selected word count number has a zero value, a harmonic counter select means responsive to said encoded select signal whereby a fraction of the count state of said harmonic counter is selected to form a selected harmonic count number, an adder-accumulator means wherein said selected harmonic count number is successively added to the content of an accumulator in response to said logic timing signals and wherein the content of said accumulator is intialized to a zero value at the start of each one of said sequence of computation cycles, a scaling means responsive to said encoded select signal whereby a fraction of the data value contained in the accumulator of said adder-accumulator means is selected to form a selected function argument value, and computation logic means responsive to said selected word count number, responsive to said selected harmonic count number, and responsive to said select function argument value whereby the number of said plurality of data words is varied in response to the fundamental frequency of a generated musical tone associated with an actuated keyswitch.

6. Apparatus according to claim 5 wherein said harmonic addressing means comprises;

memory addressing circuitry for reading out said preselected set of harmonic coefficients from said harmonic coefficient memory means in response to said selected harmonic count number.

7. Apparatus according to claim 5 wherein said computation logic means comprises;

a sinusoid table for storing a set of trigonometric function values, a sinusoid table addressing means responsive to said select function argument value for reading out a trigonometric function value from said sinusoid table, a multiplying means for multiplying the trigonometric value read out from said sinusoid table with a harmonic coefficient read out from said harmonic coefficient means to form a product value, and a summing means wherein said product value is added to a data word read out from a waveshape memory means in response to said selected word count number and whereby the added value is stored in said waveshape memory.

8. Apparatus according to claim 2 wherein said means for producing musical tone comprises;

a frequency adder-accumulator means for successively adding said generated frequency number to the contents of an accumulator to produce an accumulated frequency number, a frequency select means responsive to said encoded select signal whereby a fraction of said accumulated frequency number is selected to form a selected summed frequency number, a memory addressing means for reading out a data word from said waveshape memory means at an addressing corresponding to said selected summed frequency number, and a means for a conversion whereby said data word read out from said waveshape memory means is converted into an analog signal corresponding to said musical tone.

9. In combination with a keyboard operated musical instrument having a plurality of keyswitches, each of which corresponds to an assigned musical frequency, in which a plurality of data words corresponding to a musical waveform are computed and are transferred sequentially and converted into a musical tone waveshape at a rate corresponding to musical frequency associated with an actuated keyswitch, apparatus for adaptively varying the number of said plurality of data words to said musical frequency comprising;

a detection means responsive to the closure of a keyswitch in said plurality of keyswitches whereby a select signal is encoded to denote the musical frequency associated with said closed keyswitch, a harmonic coefficient memory means for storing a preselected set of harmonic coefficients, a harmonic coefficient addressing means responsive to said select signal for reading out a subset of said preselected harmonic coefficients from said harmonic coefficient memory means, a waveshape memory means, a computing means responsive to said select signal and responsive to said subset of preselected harmonic coefficients read out from said harmonic coefficient memory means whereby said plurality of data words are computed and stored in said waveshape memory means and whereby the number of said plurality of data words is adaptively varied to correspond to said assigned musical frequency, and a means for producing musical tones in response to the plurality of data words stored in said waveshape memory means.

* * * * *

UNITED STATES PATENT AND TRADEMARK OFFICE

CERTIFICATE OF CORRECTION

PATENT NO. : 4,601,229

DATED : July 22, 1986

INVENTOR(S) : Ralph Deutsch

It is certified that error appears in the above-identified patent and that said Letters Patent are hereby corrected as shown below:

Column 2, line 13 change "compute" to --computed--.

Column 2, line 22 insert "a" after --of--.

Column 4, line 37 change "add-accumulator" to --adder-accumulator--.

Column 5, line 28 change "$2^5x2^4$32 512" to --$2^5x2^4$=512--.

Column 6, line 17 change "addressees" to --addresses--.

Column 6,line 22 change "oly" to --only--.

Column 6, line 55 change "2-(M-N)/12" to -- $2^{-(M-N)/12}$ --.

Column 6, line 67 change "stoned" to --stored--.

Column 6, line 68 change "successivey" to --successively--.

Column 8, line 30 after "words" insert --stored--.

Column 8, line 62 change "on" to --one--.

Column 10, line 5, change "tone" to -- tones --.

Column 10, line 16 change "addressing" to --address--.

Signed and Sealed this

Fourteenth Day of October, 1986

[SEAL]

*Attest:*

DONALD J. QUIGG

*Attesting Officer*

*Commissioner of Patents and Trademarks*